United States Patent [19]

Kago et al.

[11] Patent Number: 4,602,256

[45] Date of Patent: Jul. 22, 1986

[54] LUGGAGE DOOR UNLOCKING DEVICE FOR A VEHICLE

[75] Inventors: Yoshiyuki Kago, Nukata; Shigeyuki Akita, Okazaki, both of Japan

[73] Assignee: Nippon Soken, Inc., Nishio, Japan

[21] Appl. No.: 579,503

[22] Filed: Feb. 13, 1984

[30] Foreign Application Priority Data

Feb. 14, 1983 [JP] Japan ..... 58-21418
Mar. 2, 1983 [JP] Japan ..... 58-35002

[51] Int. Cl.[4] ..... G08C 19/00

[52] U.S. Cl. ..... 340/825.72; 340/539; 367/909; 367/197

[58] Field of Search ..... 367/197–199, 367/117, 135, 909; 200/298, DIG. 2, DIG. 6, DIG. 20; 307/10 R, 10 AT, 117; 340/825.72, 825.31, 825.69, 539; 181/125; 180/167–169; 343/7 VC, 7 VM

[56] References Cited

U.S. PATENT DOCUMENTS 3,440,347 4/1969 Spencer et al. ..... 367/197
3,506,956 4/1970 Kolm et al. ..... 340/825.72 X
3,922,629 11/1975 Hayakawa ..... 367/909
3,970,987 7/1976 Kolm ..... 367/197 X
4,023,178 5/1977 Suyama ..... 340/825.69 X
4,404,541 9/1983 Kodera et al. ..... 367/909 X
4,405,924 9/1983 Shinoda et al. ..... 307/10 R X
4,450,545 5/1984 Kishi et al. ..... 307/117 X

FOREIGN PATENT DOCUMENTS 1227835 4/1971 United Kingdom ..... 200/DIG. 2

*Primary Examiner*—Ulysses Weldon
*Attorney, Agent, or Firm*—Cushman, Darby & Cushman

[57] ABSTRACT

A luggage door unlocking device for a vehicle, by which a luggage door of the vehicle can be unlocked without using an unlocking key, is disclosed. The device comprises a portable transmitter for generating an unlocking signal of ultrasonic wave, an ultrasonic wave receiver which is mounted on the vehicle and which receives an ultrasonic wave from the portable transmitter, a discriminating means for subjecting the signal received by the ultrasonic wave receiver to waveform shaping to obtain a high-frequency pulse train and detecting a high-frequency pulse train of a predetermined pattern to obtain the unlocking signal, and an unlocking mechanism for unlocking the luggage door of the vehicle upon receipt of the unlocking signal after discrimination by the discriminating means. The transmitter has a power supply switch which is enclosed in a case having a clip for attachment to the clothes of the person who carries the transmitter and which is closed upon attachment of the clip to the clothes.

11 Claims, 18 Drawing Figures

S(113)
D1
D2
D3
D4
D5
D6
S(62)
S(31A)
S(31D)
S(31C)
S(32I)
S(32M,Q̄)
S(32K,Q9)
S(32K,Q13)

LUGGAGE DOOR UNLOCKING DEVICE FOR A VEHICLE

BACKGROUND OF THE INVENTION

The present device relates to a luggage door unlocking device for a vehicle, which can unlock a luggage door of the vehicle, particularly a trunk lid without using an unlocking key.

The device of this type is composed of a portable transmitter for generating an unlocking signal, a receiver which is mounted on a vehicle body for receiving the unlocking signal generated by the transmitter when the transmitter approaches the vehicle, and an unlocking means for operating an unlocking mechanism of the trunk lid when the receiver receives the unlocking signal.

According to the device of this type, the trunk lid can be automatically unlocked when the person carrying the transmitter approaches the trunk lid. Therefore, when both hands are full with luggage, the trunk lid can be unlocked without using a key.

On the other hand, there has recently appeared a vehicle which carries thereon a signal processing device (e.g. a device for communication between vehicles, or a device for detecting an obstacle located behind a vehicle during a backward movement of the vehicle) for performing the transmission and reception of a signal through ultrasonic wave transmitter and receiver which are mounted on the rear portion of the vehicle. In such a vehicle, it is difficult to mount the receiver of the foregoing unlocking device in the limited rear space.

SUMMARY OF THE INVENTION

One object of the present invention is to provide a luggage door unlocking device which utilizes a ultrasonic wave and which assures an exact operation.

Another object of the present invention is to provide a luggage door unlocking device which permits an ultrasonic wave receiver mounted on a vehicle for detecting an obstacle located behind the vehicle to be used also as a receiver for receiving an unlocking signal.

Still another object of the present invention is to provide a luggage door unlocking device provided with a portable transmitter which is easy to carry and generate an unlocking signal automatically when the transmitter is in carry.

The luggage door unlocking device of the present invention comprises a portable transmitter which comprises a case and a transmitting means for generating an unlocking signal of ultrasonic wave, the transmitting means being enclosed in the case; a receiving means which comprises an ultrasonic wave receiver and a discriminating means for discriminating the signal received by the ultrasonic wave receiver to obtain the unlocking signal, both the ultrasonic wave receiver and the discriminating means being mounted on a vehicle; and an unlocking means for operating a luggage door unlocking mechanism mounted on the vehicle upon receipt of the unlocking signal after discrimination by the discriminating means, wherein said portable transmitter may have a clip for attaching the transmitter to a pocket or the like of the clothes of the person carrying the transmitter, and a switch contact for operating the transmitting means when the clip is attached to the clothes, the clip and the switch contact being attached to the transmitter case.

When the person carrying the portable transmitter returns to his vehicle after making a purchase and enters into a predetermined unlocking signal receivable range formed about the receiving means, the luggage door is automatically unlocked.

Figure 3:
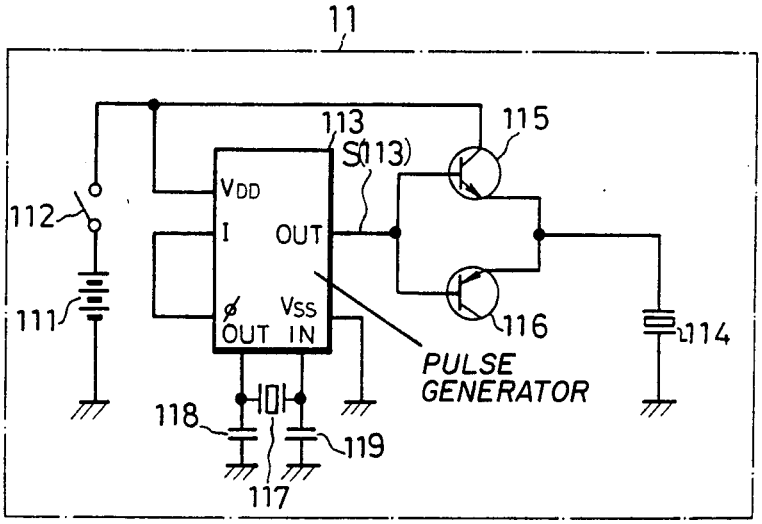
FIG. 3 is a view showing an example of an electric circuit of a transmitting means mounted within the portable transmitter.
Figure 4:
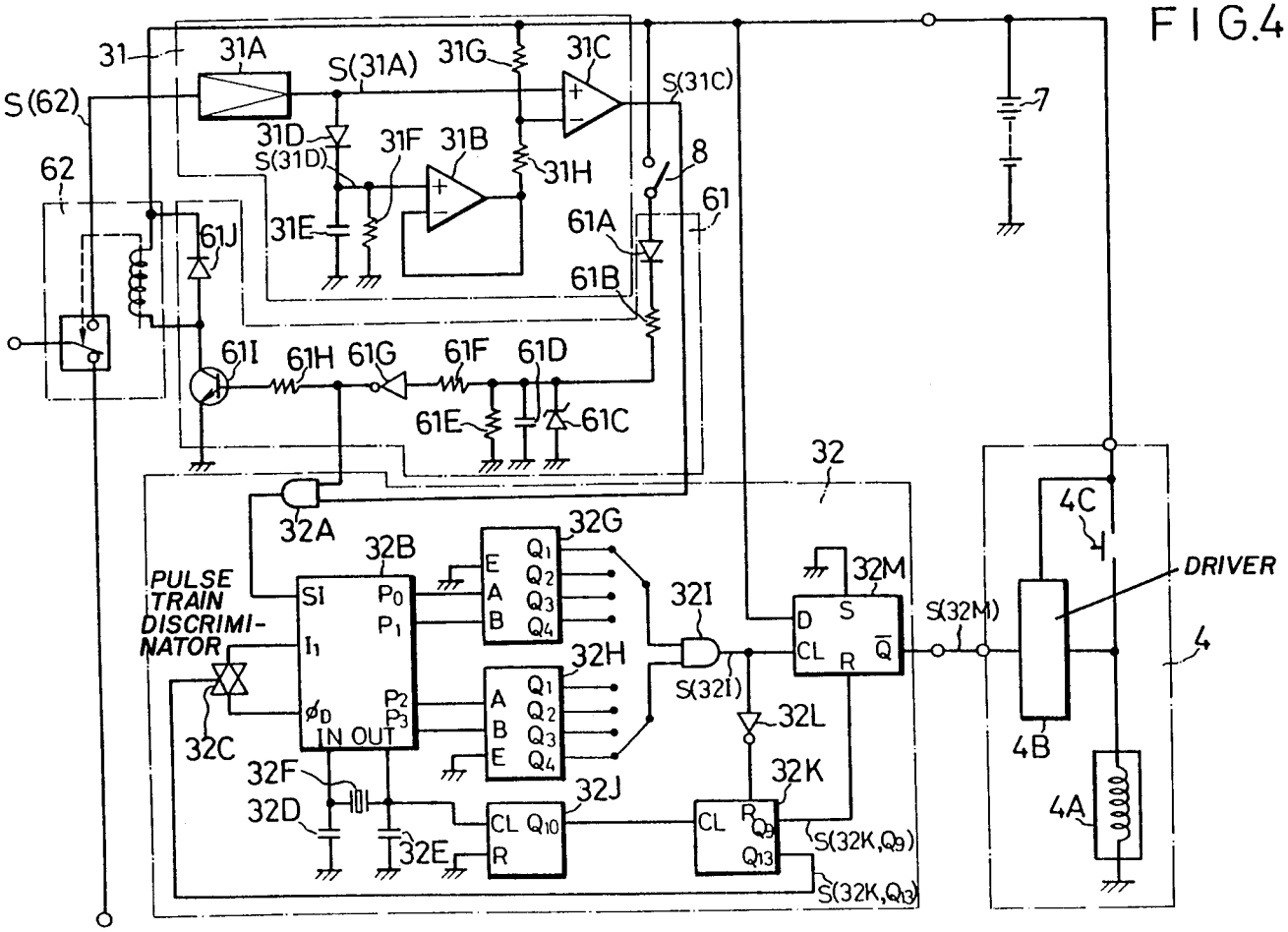
FIG. 4 is a view showing an example of an electric circuit of the discriminating means, unlocking means and switching means.
Figure 6:
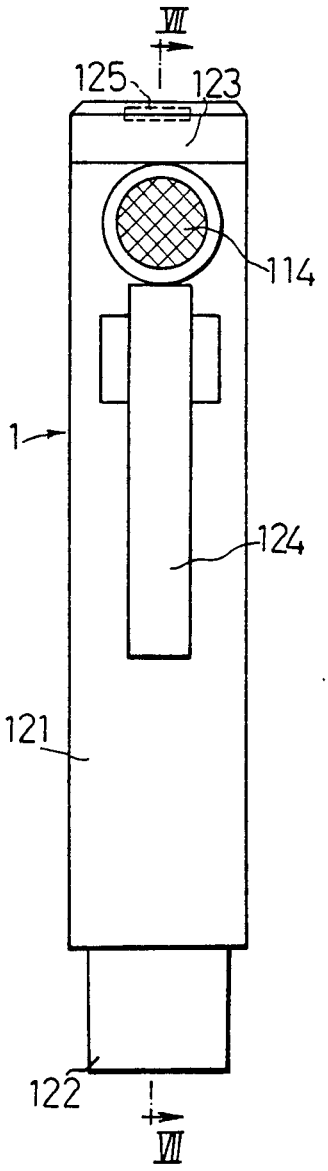
Figure 7:
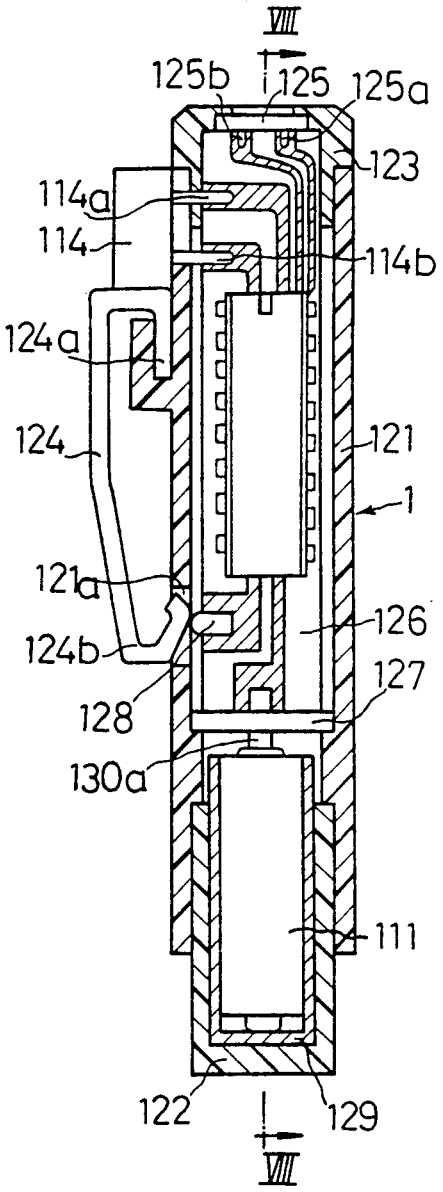
Figure 8:
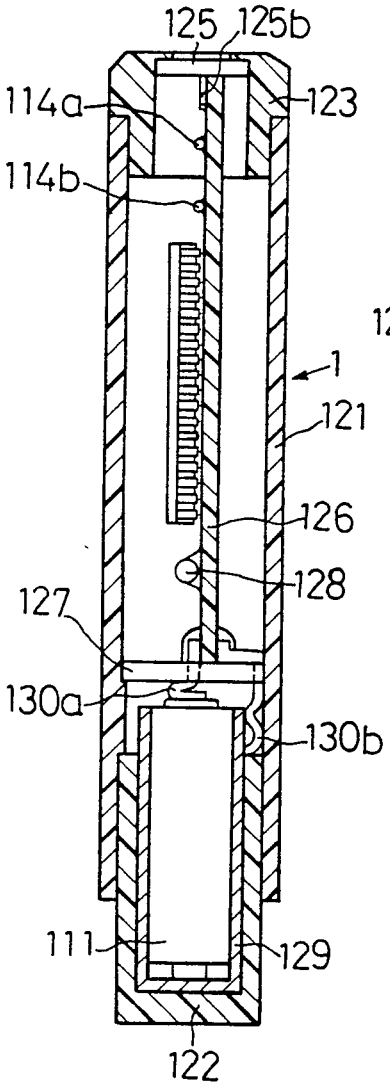
Figure 10:
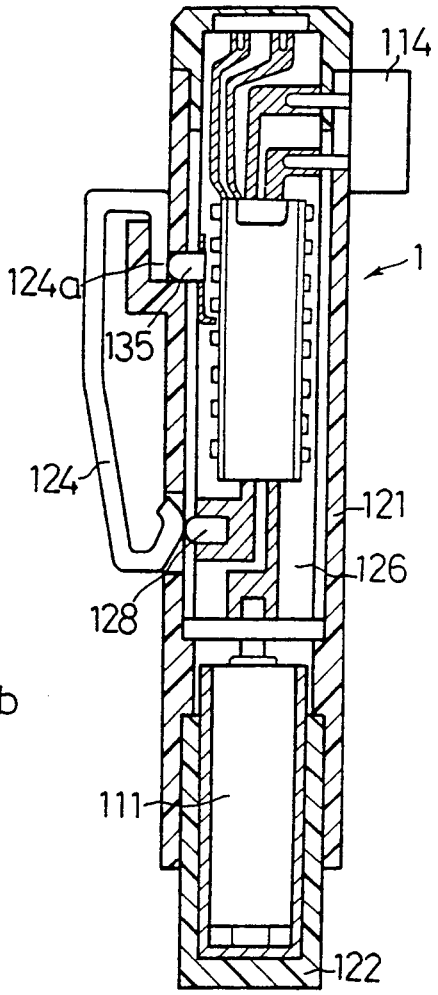
Figure 9:
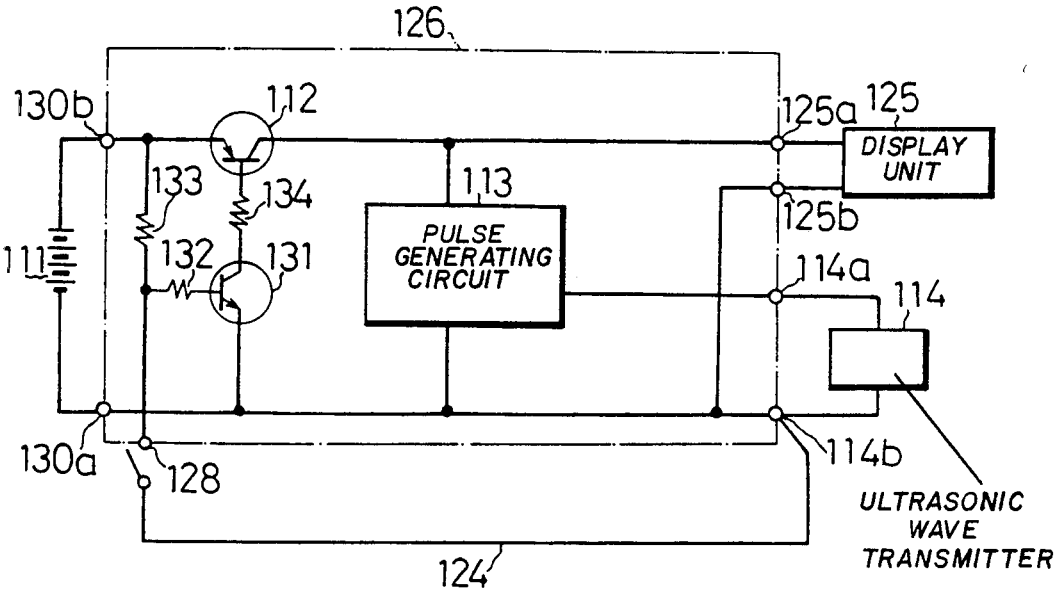

FIGS. *5a–5i* are views showing waveforms of various signals in the electric circuit of FIGS. 3 and 4;

FIG. 6 is a front view showing an example of the portable transmitter;

FIG. 7 is a longitudinal sectional view taken along line VII—VII of FIG. 6;

FIG. 8 is a longitudinal sectional view taken along line VIII—VIII of FIG. 7;

FIG. 9 is a view showing another example of an electric circuit of a transmitting means mounted within the portable transmitter; and FIG. 10 is a longitudinal sectional view showing another example of the portable transmitter.

DETAILED DESCRIPTION

The present invention will be described hereinunder on the basis of its embodiments illustrated in the accompanying drawings.

Figure 1:
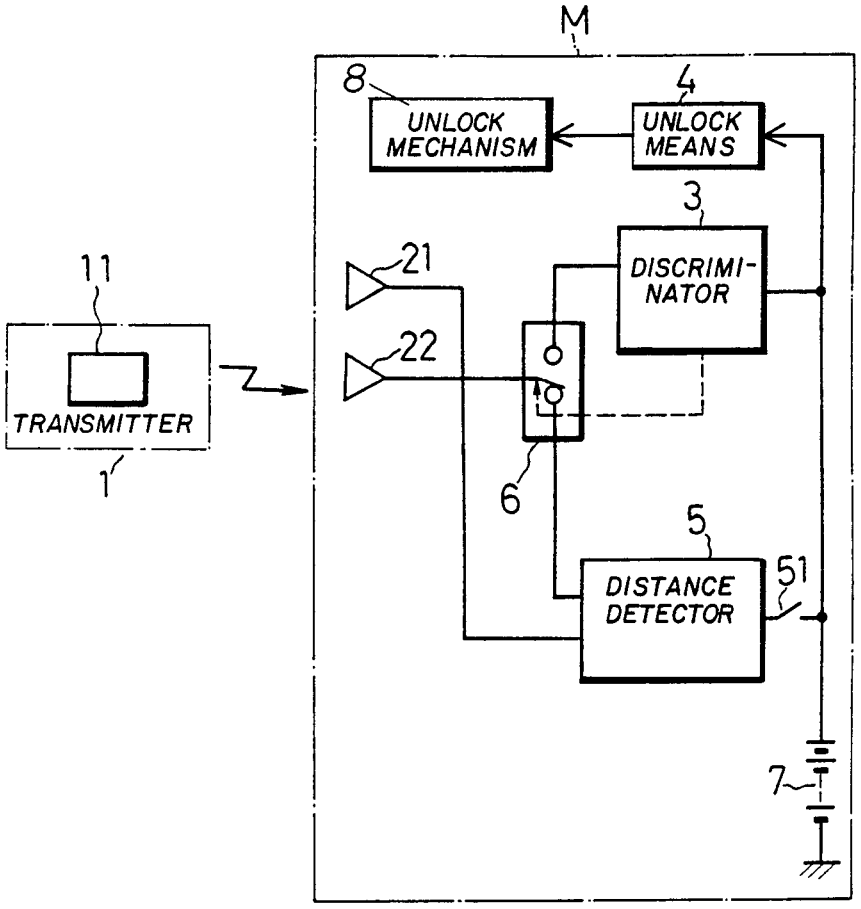
FIG. 1 is a view showing the entire construction of the luggage door unlocking device.
Figure 2:
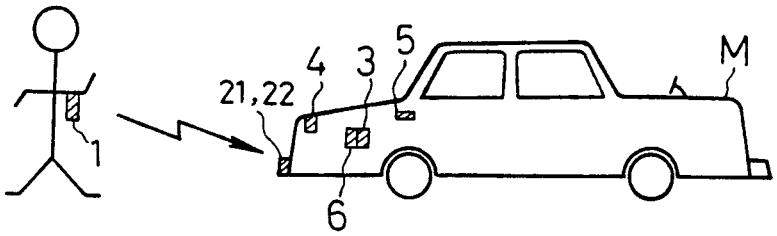
FIG. 2 is a view showing how the above unlocking device is arranged.

The construction of the luggage door unlocking device for a vehicle of the present invention is shown in FIG. 1, and the arrangement thereof is shown in FIG. 2. In these figures, the numeral 1 denotes a portable transmitter which the driver carries and in which is mounted a transmitting means 11 for generating an unlocking signal of ultrasonic wave. The numerals 21 and 22 denote an ultrasonic wave transmitter and an ultrasonic wave receiver, respectively, which are enclosed in a rear bumper of a vehicle M. The numeral 3 denotes a discriminating means for discriminating the unlocking signal provided from the transmitter 1; numeral 4 denotes an unlocking means for operating an unlocking mechanism 8 upon receipt of the unlocking signal from the discriminating means 3; numeral 5 denotes a distance detecting means as a signal processing unit for detecting, when the vehicle moves back, the distance to an obstacle located behind the vehicle on the basis of the time taken from when an ultrasonic wave is generated by the ultrasonic wave transmitter 21 until when it is reflected by the obstacle and returns to the ultrasonic wave receiver 22; and numeral 6 denotes a switching means for switching the connection of the ultrasonic wave receiver 22 from the distance detecting means 5 to the discriminating means 3 during parking of the vehicle. In FIG. 1, the numeral 7 denotes a vehicular battery and numeral 51 denotes a switch which is set so as to supply electricity to the distance detecting means 5 only when the vehicle is in a driving condition (when the ignition switch is ON).

Referring now to FIG. 3, there is shown an example of circuit of the transmitting means 11. The transmitting means 11 includes a built-in power source 111, a power supply switch 112, a pulse generating circuit 113 (e.g. M58480P manufactured by Mitsubishi Electric Corporation) which generates a high-frequency pulse train of a predetermined pattern, and an ultrasonic wave transmitter 114. In the figure, the numerals 115 and 116 denote transistors for driving the ultrasonic wave transmitter 114, the numeral 117 denotes a ceramic oscillator, and the numerals 118 and 119 denote capacitors.

Referring now to FIG. 4, there is shown an example of circuit of the discriminating means 3, unlocking means 4 and switching means 6. The discriminating means 3 comprises a waveform shaping circuit 31 and a discriminating circuit 32. The waveform shaping circuit 31 comprises an amplifier 31A, operational amplifiers 31B and 31C, a diode 31D, a capacitor 31E, and resistors 31F, 31G and 31H. The discriminating circuit 32 comprises an AND gate 32A, a pulse train discriminating circuit 32B (e.g. M58481P manufactured by Mitsubishi Electric Corporation) for discriminating a high-frequency pulse train of a predetermined pattern, an analog switch 32C, capacitors 32D and 32E, a ceramic oscillator 32F, decoders 32G and 32H (e.g. TC4555 manufactured by Toshiba Corporation), and AND gate 32I, counters 32J and 32K, an inverter 32L and a flip flop 32M.

The unlocking means 4 comprises an electromagnetic coil 4A for operating the unlocking mechanism, a circuit 4B for energizing the electromagnetic coil 4A, and an operating switch 4C which can operate the unlocking mechanism 8 optionally by applying the voltage of the vehicular battery 7 directly to the electromagnetic coil 4A.

The switching means 6 comprises a detecting circuit 61 for detecting whether an ignition switch 8 is on or off, and a switching relay 62. The detecting circuit 61 comprises a diode 61A, a resistor 61B, a Zener diode 61C, a capacitor 61D, resistors 61E and 61F, an inverter 61G, a resistor 61H, a transistor 61I and a diode 61J.

The luggage door unlocking device constructed as above operates in the following manner. First, explanation will be given about the switching of connection of the ultrasonic wave receiver 22 with respect to the discriminating means 3 and the distance detecting means 5. In FIG. 4, when the ignition switch 8 is ON, the input terminal of the inverter 61G becomes a high level and the output thereof is at a low level, so that the relay 62 is turned (as shown) on the side of the distance detecting means 5 and the ultrasonic wave receiver 22 is thereby connected to the distance detecting means 5 to detect an obstacle located behind the vehicle. Conversely, when the ignition switch 8 is OFF, the input terminal of the inverter 61G becomes a low level and the output thereof is at a high level, so that the transistor 61I turns ON and the relay 62 switches from the distance detecting means 5 to the waveform shaping circuit 31 which is a constituent member of the discriminating means 3.

Figures 5A, 5B, 5C, 5D, 5E, 5F, 5G, 5H, 5I:
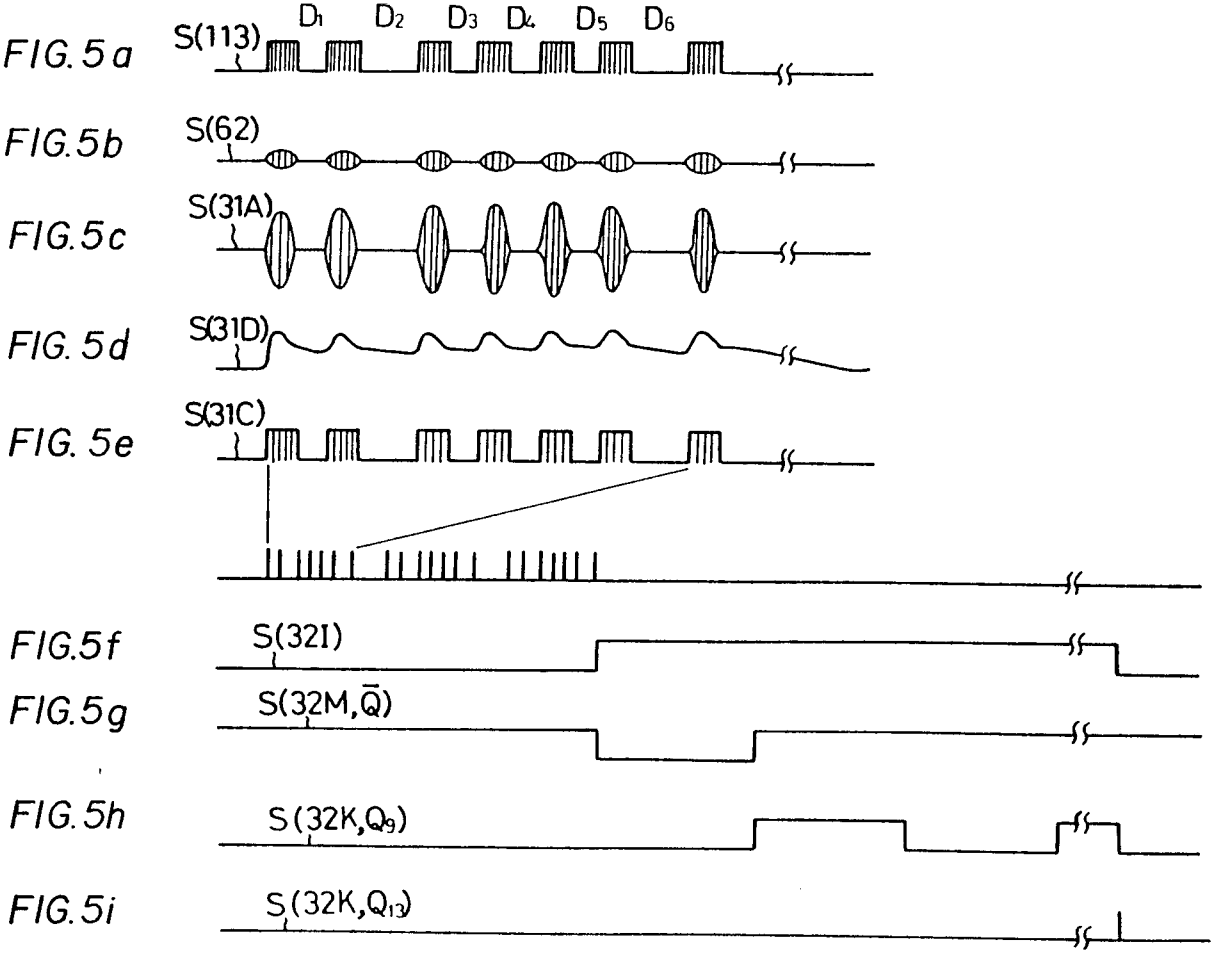

In FIG. 3, the pulse generating circuit 113 as a constituent member of the transmitting means 11 mounted within the portable transmitter 1 generates a specific 6-bit high-frequency pulse train S(113) (see FIG. 5*a*), and the ultrasonic wave transmitter 114 outputs the pulse train thus produced. The ultrasonic wave receiver 22 (see FIG. 1) receives a transmitted signal S(62) (see FIG. 5*b*), which signal is then amplified by means of the amplifier 31A (see FIG. 5*c*). The thus-amplified signal is subjected to envelope detection in the circuit comprising diode 31D, capacitor 31E and resistor 31F to obtain a signal S(31D) (see FIG. 5*d*). The operational amplifier 31C compares the amplified signal S(31A) with the detected signal S(31D) and outputs a high-frequency pulse train signal S(31C) (see FIG. 5*e*). Thus, since the amplified signal S(31A) is compared with the detected signal S(31D) whose magnitude varies in proportion thereto, the pulse waveform S(31C) is obtainable even at a lowered level of the received signal S(62).

The pulse train discriminating circuit 32B, when it receives a predetermined pulse train signal S(31C) three times, outputs corresponding binary data from its output terminals $P_0$–$P_3$. For example, when the pulse train S(31C) shown in FIG. 5*e*is fed to the circuit 32B, the output terminals $P_0$–$P_3$ become 0, 0, 1 and 1, respectively. As a result, output terminals $Q_1$ and $Q_4$ of the decoders 32G and 32H respectively become 1. When an output S(32I) of the AND gate 32I becomes a high level, a $\overline{Q}$ output S(32M) of the flip flop 32M falls to a low level (see FIG. 5*g*). Further, the counter 32*k* is released from its reset state and starts counting, and when a $Q_9$ output S(32K, $Q_9$) of the counter 32*k* reaches a high level, the $\overline{Q}$ output S(32M) of the flip flop 32M returns to a high level. When a $Q_{13}$ output S(32*k*, $Q_{13}$) of the counter 32K reaches a high level, the analog switch 32C turns ON and renders low all the output levels of $P_0$–$P_3$ of the pulse train discriminating circuit 32B, thus causing the circuit 32B to assume a waiting state, whereby the counter 32K is reset again.

The driving circuit 4B as a constituent member of the unlocking means 4 energizes the solenoid 4A when the $\overline{Q}$ output S(32M) of the flip flop 32M of the discriminating circuit 32 is at a low level, thereby causing the unlocking mechanism to operate.

FIG. 6 is a front view of the portable transmitter 1, FIG. 7 is a longitudinal sectional view taken along line VII—VII of FIG. 6, and FIG. 8 is a longitudinal sectional view taken along line VIII—VIII of FIG. 7. In these figures, the numerals 121 and 122 denote upper and lower cases, respectively, which are both cylindrical and integrally coupled together. The upper end of the upper case 121 is covered with a cap 123. Mounted on the outer surface of the upper case 121 are clip 124 formed of a resilient material and the ultrasonic wave transmitter 114. The clip 124 is for holding a part of clothes between it and the outer surface of the upper case 121 is thereby attach the upper case 1 to the clothes.

The ultrasonic wave transmitter 114 is mounted in a position above and adjacent to the clip 124 so that it is exposed to the exterior from an opening edge of a pocket or the like of clothes when the portable transmitter 1 is attached to the pocket or the like. Further, a display unit 125 is mounted on the upper end portion of the cap 123 so that its display surface faces up (toward the face of the person who carries the transmitter) when the transmitter 1 is attached to a breast pocket of the clothes of the person carrying the transmitter.

As shown in FIGS. 7 and 8, a printed circuit board 126 on which are formed the power supply switch 112, the pulse train generating circuit 113, etc. is enclosed in the upper case 121, while in the lower case 122 is enclosed the power source or dry cell 111. The clip, which is generally C-shaped, has one end 124*a* which is fixed to the upper case 121 and the other end 124*b* which faces a hole 121*a* formed in the upper case 1.

The ultrasonic wave transmitter 114 has lead terminals 114*a* and 114*b* extending through the upper case 121 into the interior of the case, and a metallic housing of the ultrasonic wave transmitter 114 is electrically connected to the earthing lead 114*b* and the clip 124.

The lower end of the printed board 126 is in abutment with a disc-like terminal board 127, and the printed board 126 is held in place between the cap 123 and the terminal board 127 which is press-fitted in the upper case 121.

The printed board 126 supports the ultrasonic wave transmitter 114 and the display unit 125, and also serves to form a switch contact with respect to the clip 124. More specifically, the lead terminals 114*a* and 114*b* of the ultrasonic wave transmitter 114 are fixed by soldering to a copper foil pattern formed on the printed board 126, whereby the transmitter 114 is held in place. Likewise, lead terminals 125*a* and 125*b* of the display unit 125 are fixed to the printed board 126. Further, a contact electrode 128 is fixed by soldering to the printed board 126 in a position corresponding to the hole 121*a* formed in the upper case 121. The other end 124*b* of the clip 124 is in resilient contact with the contact electrode 128 within the hole 121*a* to constitute a switch contact.

In the lower case 122 is mounted a metallic case 129 for enclosing the dry cell 111 therein. Two electrodes 130*a* and 130*b* (see FIG. 8) extend through the terminal board 127 and are connected at one end thereof to the printed board 126 by soldering. The other ends of the electrodes 130*a* and 130*b* extend downward and are electrically connected to one electrode of the dry cell 111 and the metallic case 129.

The assembling order of the portable transmitter 1 will now be described. First, the following three parts are fabricated by separate steps. The first part is the lower case 122 with the dry cell 111 enclosed therein. The second part is the upper case 121 with the clip 124 mounted thereon. The third part is the printed board 126 with the ultrasonic wave transmitter 114, display unit 125, contact electrode 128 and other circuit elements fixed thereto by soldering. After enclosing the printed board 126 in the upper case 121, the lower case 122 is coupled to the upper case 121, and then the cap 123 is applied to the upper case 121.

Referring now to FIG. 9, there is illustrated an electric circuit formed on the printed board 126, in which the numeral 112 denotes a switching transistor serving as the power supply switch, and the numeral 113 is the foregoing pulse train generating circuit. The numeral 131 denotes a driving transistor for driving the switching transistor 112. To the base of the driving transistor 131 are connected resistors 132 and 133 and the contact electrode 128. When the portable transmitter 1 is attached to a part of the clothes of the person who carries it, the contact electrode 128 and the clip 124 are spaced from each other, so that the driving transistor 131 turns ON and applies a bias to the switching transistor 112 through the resistor 134, thereby causing the transistor 112 to turn ON. Thus, the clip 124 serves as a movable contact with respect to the contact electrode 128. When the portable transistor 1 is not attached to the clothes of the person who carries it, the clip 124 comes into contact with the contact electrode 128 by virtue of its own returning force and conducts to turn OFF the transistor 112.

In the portable transmitter 1, as set forth hereinabove, the generation and stop of generation of the unlocking signal are performed in accordance with the operation of the clip 124. That is, when the portable transmitter 1 is attached through the clip 124 to a part of the clothes of the person who carries it, the switch contact composed of the clip 124 and the contact electrode 128 is opened, so that the transistor 112 conducts and a high-frequency pulse train as an unlocking signal is provided from the pulse train generating circuit 113 to the ultrasonic wave transmitter 114, which in turn generates an unlocking signal of ultrasonic wave directly without being intercepted by the clothes. At the same time, the display unit 125 provides a luminous display at the upper end of the upper case 121 to indicate that the portable transmitter 1 is ON.

When the portable transmitter 1 is detached from the clothes, the clip 124 comes into contact with the contact electrode 128 by virtue of its own resilient force, so that the transistor 112 is turned OFF and the pulse train generating circuit 113 and display unit 125 stop operating.

The cases 121 and 122 of the portable transmitter 1 may be decorated for use as a tie pin or a brooch. In this case, as shown in FIG. 10, the ultransonic wave transmitter 114 and the clip 124 are mounted on the outer surface of the upper case on opposite sides of the case, and the base end 124*a* of the clip 124 is connected through a lead member 135 to an earthing line on the printed circuit board 126.

Thus, according to the present invention, there can be provided an ultrasonic wave type luggage door unlocking device which is extremely compact and is simple in construction.

In the luggage door unlocking device of the present invention, moreover, the ultrasonic wave receiver can be used in common to both the unlocking device and the device for detecting an obstacle located behind a vehicle.

Further, the portable transmitter in the luggage door unlocking device of the present invention is extremely easy to carry, and when carried it generates an unlocking signal automatically and thus dispenses with the operation of a switch for signal generation.

What is claimed is:

1. A luggage door unlocking device for a vehicle, comprising:

(1) a portable transmitter which comprises a case and a transmitting means for generating an unlocking signal having an ultrasonic frequency, said transmitting means being supported by said case;

(2) a receiving means mounted on the vehicle and comprising an ultrasonic wave receiver for receiving an ultrasonic signal from the outside of the vehicle, a discriminating means for discriminating the signal received by said receiver to obtain said unlocking signal, a signal processing means for transmitting an ultransonic signal out of the vehicle and processing the signal received by said receiver, and a switching means for connecting said ultrasonic wave receiver to said discriminating means when said vehicle is not operating and for connecting said ultrasonic wave receiver to said signal processing means when the vehicle is operating; and (3) an unlocking means mounted on the vehicle for operating a luggage door unlocking mechanism of the vehicle upon receipt of said unlocking signal after discrimination by said discriminating means.

2. A luggage door unlocking device for a vehicle according to claim 1, wherein said discriminating means comprises a waveform shaping circuit for subjecting the signal received by said ultrasonic wave receiver to waveform shaping to obtain a high-frequency pulse train, and a discriminating circuit for determining whether the high-frequency pulse train shaped by said waveform shaping circuit is the train of a predetermined pattern to obtain said unlocking signal.

3. A luggage door unlocking device for a vehicle according to claim 1, wherein said switching means comprises a detecting circuit for detecting whether an ignition switch for an engine of the vehicle is on or off, and a switching relay which is operated by said detecting circuit so as to connect said ultrasonic wave receiver with said discriminating means when the ignition switch is off.

4. A luggage door unlocking device for a vehicle according to claim 1, wherein said unlocking means has an electromagnetic coil for operating the luggage door unlocking mechanism and a driving circuit for energizing said electromagnetic coil upon receipt of said unlocking signal.

5. A luggage door unlocking device according to claim 1, wherein said signal processing means is a means for detecting an obstacle located behind a vehicle during a backward movement of the vehicle.

6. A luggage door unlocking device for a vehicle, comprising:

(1) a portable transmitter which comprises a case and a transmitting means for generating an unlocking signal having an ultrasonic frequency, said transmitting means being supported by said case and comprising a power source, a pulse train generating circuit for generating a high-frequency pulse train of a predetermined pattern, an ultrasonic wave transmitter which generates an unlocking signal of ultrasonic frequency in response to said high-frequency pulse train, a power supply switch interposed between said pulse train generating circuit and said power source, and a power supply switch driving circuit for driving said power switch;

(2) a receiving means mounted on the vehicle and comprising an ultrasonic wave receiver for receiving an ultrasonic signal from the outside of the vehicle, a discriminating means for discriminating the signal received by said receiver to obtain said unlocking signal, a signal processing means for transmitting an ultrasonic signal out of the vehicle and processing the signal received by said receiver, and a switching means for connecting said ultrasonic wave receiver to said discriminating means when said vehicle is not operating and for connecting said ultrasonic wave receiver to said signal processing means when the vehicle is operating; and (3) an unlocking means mounted on the vehicle for operating a luggage door unlocking mechanism of the vehicle upon receipt of said unlocking signal after discrimination by said discriminating means;

said portable transmitter being further provided with a retaining means for attaching said case to a part of the clothes of a person who carries the portable transmitter, said retaining means being mounted on the outer surface of said case and having a switch contact connected to said power supply switch driving circuit said retaining means being adapted to open and close in response to the attaching and detaching operation of said retaining means and generating a signal for driving said power supply switch.

7. A luggage door unlocking device for a vehicle according to claim 6, wherein said retaining means comprises a clip of a plate spring made of an electrically conductive material, one end of said clip being fixed to the side face of said case and the other end of said clip being in resilient contact with the side face of said case, and said switch contact comprises said other end of said clip and a contact which is exposed to the side face of said case and which is in contact with said other end of said clip, said contact exposed to the side face of the case being connected to said power supply switch driving circuit, whereby when a part of the clothes of the person who carries said portable transmitter is held between said other end of said clip and said contact exposed to the side face of said case, said switch contact is opened and said power supply switch is closed.

8. A luggage door unlocking device for a vehicle according to claim 7, wherein said pulse train generating circuit, said power supply switch and said power supply switch driving circuit are formed on a printed circuit board which is enclosed in said case.

9. A luggage door unlocking device for a vehicle according to claim 8, wherein said ultrasonic wave transmitter is enclosed in an electrically conductive housing, said housing being fixed to the side face of said case while being contacted with the fixed end of said clip, and said housing being connected to an earthing line on said printed circuit board.

10. A luggage door unlocking device for a vehicle according to claim 8, wherein said ultrasonic wave transmitter is mounted on the side face of said case in a position opposite to said clip, and the fixed end of said clip is connected to an earthing line on said printed circuit board through a lead member.

11. A luggage door unlocking device according to claim 6, wherein said ultrasonic wave transmitter is provided on a side face of said case so that when said case is attached to a part of the clothes of the person carrying said portable transmitter, said ultrasonic wave transmitter is exposed on the outside of his clothes.

* * * * *